United States Patent [19]

McIntyre et al.

[11] Patent Number: 4,877,961

[45] Date of Patent: Oct. 31, 1989

[54] IN-LINE ELECTRON BEAM ENERGY MONITOR AND CONTROL

[75] Inventors: Raymond D. McIntyre, Los Altos Hills; Stanley W. Johnsen, Palo Alto, both of Calif.

[73] Assignee: Varian Associates, Inc., Palo Alto, Calif.

[21] Appl. No.: 263,084

[22] Filed: Oct. 26, 1988

[51] Int. Cl.[4] ..... H01J 49/44

[52] U.S. Cl. ..... 250/397; 250/305; 313/363.1

[58] Field of Search ..... 250/505, 397; 313/363.1

[56] References Cited

U.S. PATENT DOCUMENTS

| | | | |
|---|---|---|---|
| 3,626,184 | 12/1971 | Crewe | 250/397 |
| 3,838,284 | 9/1974 | McIntyre | 250/397 |
| 3,942,012 | 3/1976 | Boux | 250/305 |
| 3,975,640 | 8/1976 | Boux et al. | 250/397 |
| 4,347,547 | 8/1982 | Gibson | 361/187 |
| 4,531,057 | 7/1985 | Kobayashi | 250/397 |

*Primary Examiner*—Bruce C. Anderson

[57] ABSTRACT

A beam of charged particles is scattered by a thin foil and the flux at two angles $\theta_1$ and $\theta_2$, is sampled to yield an exponential function of the respective energy difference, $E(\theta_2)-E(\theta_1)$. For $\theta_1=0°$, a signal representative of the energy stability of the beam is obtained and compared with a reference to form an error signal for application to the accelerator for stabilizing the beam energy and/or providing an energy interlock.

7 Claims, 2 Drawing Sheets

IN-LINE ELECTRON BEAM ENERGY MONITOR AND CONTROL

FIELD OF THE INVENTION

The invention is in the area of charged particle accelerators and relates in particular to the energy monitoring and stabilization of charged particle beams from such accelerators without momentum analysis.

BACKGROUND OF THE INVENTION

A common arrangement for the energy stabilization of accelerated charged particle beams employs momentum analysis of a collimated beam followed by a monitoring arrangement in which current sensors are disposed proximate to the beam, peripheral to the main portion thereof, to sample the analyzed beam width (in the plane of the momentum analysis). A variation in the difference between these current sensors comprises an error signal which is employed to actuate a servo system for correction appropriate to the type of accelerator. Such an arrangement requires a massive momentum analyzer and constrains the geometry of the entire system. Moreover, the current sensors typically intercept a portion of the analyzed beam and becomes sources of secondary radiation. Another arrangement, particularly common in radiation therapy and industrial radiation systems of prior art utilizing momentum analysis (magnets) comprises momentum analysis within a bend magnet, which is typically achromatic, in which no signals are derived from analyzer slits, but where sensors are placed within the radiation field downstream of the magnet. These sensors, typically located within a transmission ion chamber, will detect average and differential intensity across the radiation field. The magnet setting determines the mean energy: the sensors with appropriate servos, maintain intensity and symmetry. Where such systems do not employ a momentum analysis, the error signals derived from the ionization chamber merely maintain geometric stability or output of the charged particle beam, while true energy stability is not maintained. It is also known for prior art radiation therapy equipment to utilize an error signal derived in the above manner from a momentum analyzed beam to affect the energy of the unanalyzed beam by adjustment of some operating parameter of the accelerator.

While it is known in prior art to employ transmission ion chambers to obtain a signal proportional to angular intensity of the beam, referenced to a desired beam axis, the utility of this error signal has been employed in prior art to correct purely geometric properties of the beam or, in the alternative to cooperate with a momentum analyzer for energy stabilization.

In the prior art, it is also known to monitor the symmetry properties of an X-ray beam at a point downstream of a flattening filter and to associate detected asymmetry of a photon flux with an energy excursion of the primary electron beam. This association depends upon the angular intensity distribution of the X-ray production and is sensitivity to energy variations downstream from a flattening filter. An example of this prior art which is restricted to X-ray beams and the use of a target and flattening filter is described in U.S. Pat. No. 4,347,547.

In the present invention, an unanalyzed beam of small cross section is incident on a thin scattering foil and a measure of the angular distribution of the scattered flux is obtained. For an incident beam $I_0$, energy E, the scattered flux at scattering angle $\theta$ is given by $$I(\theta)=I_0e^{-kE}$$

where k depends upon the properties of the scatterer. If the scattered flux is monitored for two discrete angular intervals, $\theta_1$ of width $\Delta\theta_1$ and $\theta_2$ of width $\Delta\theta_2$, then, ignoring the angular widths ps $$I(\theta_1)/I(\theta_2)=e^{-k(E1-E2)} \quad \text{(Equ. 1)}$$

where $E1=E(\theta_1)$ and $E2=E(\theta_2)$. Thus, the energy distribution in the unanalyzed beam is functionally related to the angular distribution. A particularly simple arrangement is achieved for choice of one of the angles $\theta=0°$ The angular data is preferentially derived from transmission ion chamber signals to minimize secondary radiation. These signals are proportional to the flux scattered into the path traversing respective ion chamber electrodes. These latter may form a composite (for example) coplanar arrangement, or alternatively multiple ion chambers may be disposed along the axis.

A radiation therapy machine typically comprises a microwave electron accelerator mounted on a gantry. In the prior art, if an energy analysis magnet is used it deflects the accelerator beam through 90° or 270°, and the analyzed beam is derived along an axis directed toward an isocenter about which the gantry rotates. The gantry preferably provides two degrees of rotational freedom to permit the beam to be incident on the isocenter from a variety of directions.

A simular arrangement may also be utilized in accelerators for industrial applications, although in this case there is generally no fixed isocenter.

The requirement for an analyzing magnet adds considerable mass to the system and interposes an extension to path length which enlarges the required clearances for rotation of the equipment. However, a simple linear accelerator, without means for analysis of the kinetic properties of the beam, requires other means for detection and prompt correction of energy instability in the accelerated beam.

DETAILED DESCRIPTION OF THE EQUIPMENT

Figure 1:
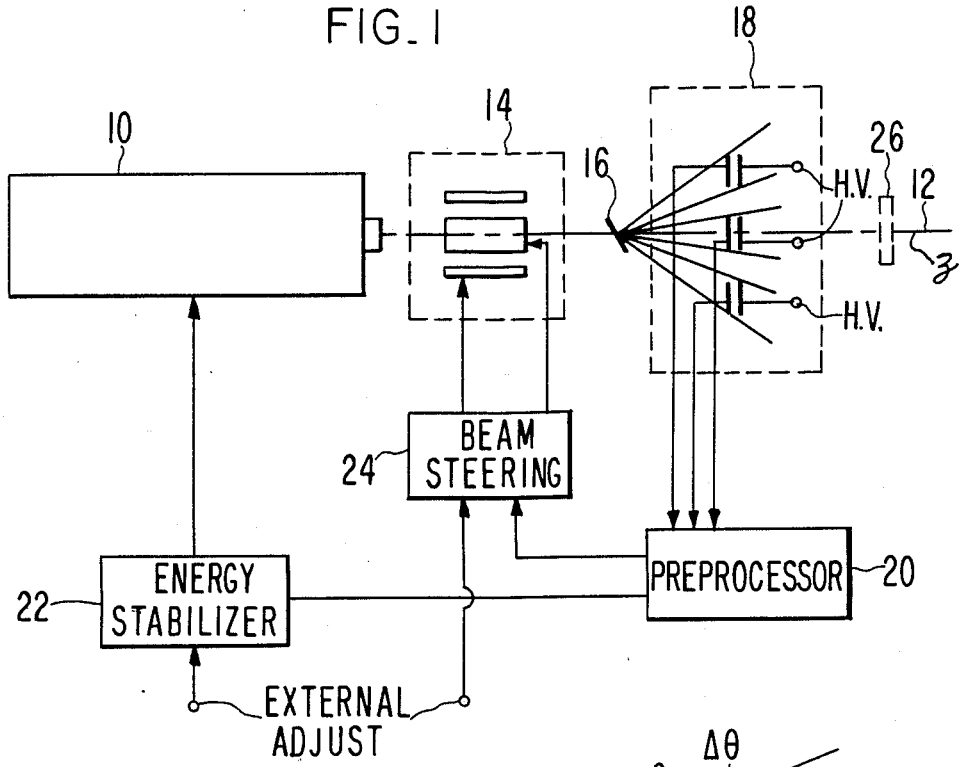
FIG. 1 is a schematic representation of the physical principle underlying the invention.

Turning now to FIG. 1, an accelerator 10 produces a beam of charged particles on z-axis 12. Displacement of the beam from axis 12 is achieved by beam steering means 14. The beam steering typically is accomplished by interaction of the beam with magnetic fields provided by coils which need not be discussed in detail. The coils may be arranged for simple beam axis rotation or, in more complex situations, multiple coils for a given deflection may be provided to obtain a true parallel displacement, if so desired.

In the present invention, momentum analysis of the beam is eschewed in favor of exploiting the energy dependence of scattering phenomena. In this manner, a massive momentum analyzer is avoided. Accordingly, a scatterer 16 is disposed on the beam axis and the angular distribution of the scattered beam flux is sampled in a manner further described below via beam distribution monitor 18 which produces signals representative of the flux directed through a plurality of distinctive angular intervals with respect to the axis 12. The signals so derived from beam distribution monitor 18 are directed to preprocessor 20 and thereafter to energy stabilizer 22 for adjustment of the accelerator 10 and to steering controller 24 for corrections of geometric fluxations of the beam. Servo arrangements for beam steering corrections are further discussed in U.S. Pat. No. 3,955,089, commonly assigned.

An X-ray target 26 may be interposed in the beam if an X-ray flux is desired, or an electron beam may be used directly, without a target.

Figure 2A:
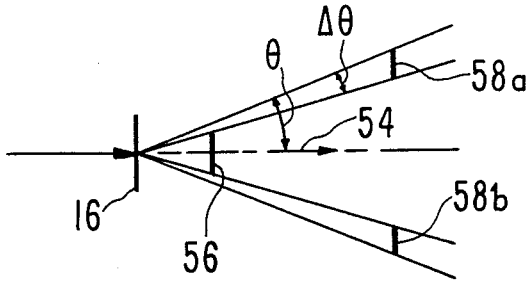
FIGS. 2*a*, 2*b* and 2*c* indicate possible alternative dispositions of flux monitor devices.
Figure 2B:
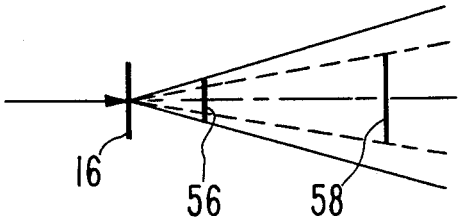

The principle of the invention is shown schematically at FIG. 2. The incident beam 50 is incident on scattering foil 16. Following the relationship (Equ. 1), the unscattered beam 54 continues undeviated, traversing the space defined by ion chamber electrode pair 56 and continues along the axis z. These electrode pairs comprise planar electrodes spaced apart in substantially parallel configurations. One electrode is ordinarily connected to the detector electronics and the other supports a selected high voltage (HV). The passage of ionizing radiation in the interelectrode space gives rise (in the present usage) to a signal proportional to the magnitude of the ionizing current flux. Transmission ion chambers are further discussed in U.S. Pat. No. 3,852,610. A portion of the beam traversing the scattering foil 52 is scattered into angular increment $\Delta\theta$ at polar angle $\theta$ and traverses ionization electrode pair 58*a* and/or 58*b*. The signal developed from ionization electrode pair 56 is proportional to the scattered beam current $I_0$ whereas the signal developed by ionization electrode pair 58 is proportional to the flux scattered through polar angle $\theta$ over the angle $\Delta\theta$. These ionization electrode pairs are disposed in axial symmetry. As indicated in FIGS. 2*a, b*, the electrode pairs 56 and 58 need not be coplanar as shown in FIG. 1. In FIG. 2*a*, the outer angle electrode pair 58 is disposed downstream from inner electrode pair 56. In FIG. 2*b*, the central portion of the beam is sampled at successive points downstream of the scatterer. In all cases, comparison of the flux transmitted through ionization electrode pair 58 with ionization electrode pair 56 yields a difference signal that will vary with changes of beam energy.

Figure 2C:
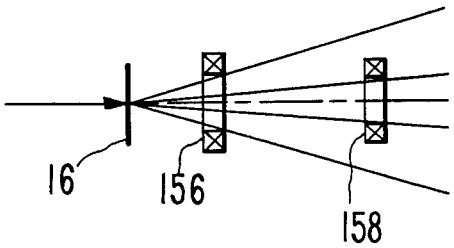

FIG. 2*c* illustrates alternate arrangements of sensors 156 and 158 (corresponding to 56 and 58) in which a toroidal transformer 156 senses the total scattered beam from foil 16, whereas toroid 158 at a downstream location senses only a part of the scattered beam. As an alternate to a toroidal transformer a metal beam collector ring may be used for sensor 158. The collector is insulated from ground and is connected to sensor electronics. Both toroidal transformer 158 or ring collector 158 will deliver a signal level that will vary relative to monitor 156 as a function of energy of the beam incident on foil 16.

Figure 3A:
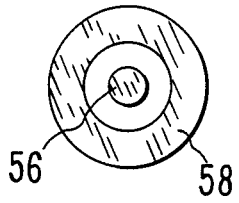
FIGS. 3*a*, 3*b* and 3*c* are schematic examples of transmission ion chambers electrode cross section.
Figure 3B:
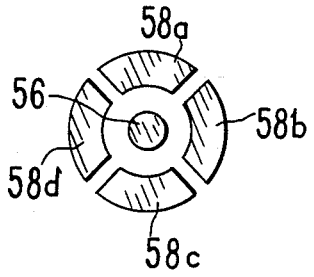
Figure 3C:
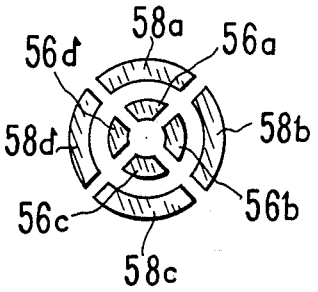

The geometry and disposition of electrode pairs may also be designed to furnish information from which the azimuthal distribution of beam flux may be inferred. In FIG. 3*b*, the annular electrode arrangement for sensing the flux scattered into $\Delta\theta$ at $\theta_2$, is segmented to permit several azimuthal angular intervals to be separately sampled. In FIG. 3*b*, the interior (central) electrode pair (of FIG. 3*a*) is similarly segmented to provide information on azimuthal distribution of the beam for both central and peripheral portions thereof.

Figure 4:
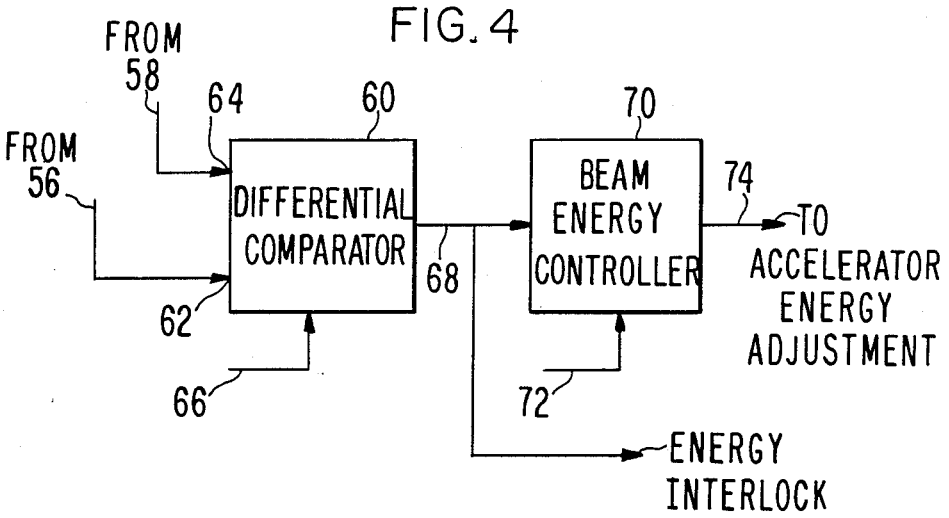
FIG. 4 shows a schematic representation of an energy stabilization portion of a system employing the invention.

Turning now to FIG. 4, there is shown a schematic block diagram for the processing of information from transmission ion chambers in accord with the principle of the invention. The total flux intercepted at an interior angular region, e.g. a central unscattered beam portion corresponding to energy $E_0$, is sampled by ionization electrode pair(s) 56. In the event that electrode pairs 56*a*, 56*b*, 56*c* and 56*d* or like segmentation is employed, a signal proportional to the sum of the flux intercepted on the various segments is directed to channel 62 of differential comparator 60. In a like manner, the signal representative of the flux intercepted by (all of) outer electrode pair(s) 58 is directed to input channel 64 of differential comparator 60. The differential comparator 60 is of conventional design and forms a signal representative of the difference of the signals presented at channels 62 and 64. This difference is compared to reference 66, a null level for a preselected voltage or current levels which characterize desired nominal energy $E_0$ (unscattered kinetic energy of the beam). Signal 68 derived from comparator 60 is proportional to an exponential function of the difference in energy between the scattered and unscattered beam portions. This signal may be applied to an energy interlock, that is set to shut the equipment off beyond a predetermined excursion of energy, and/or to an energy controller (servo). Beam energy controller 70 accepts signal 68 and reference level 72. The latter is an appropriate level for the preselected desired energy $E_0$ taken together with the structural details of the accelerator, scatterer, and scatter beam sensors. An error signal is developed within beam energy controller 70 and processed to yield correction signal 74 for application to the accelerator.

In a microwave accelerator, energy stabilization may be achieved through adjustment of rf frequency or phase, peak injected (beam source) current or peak rf power feeding the accelerator guide(s). The fact of adjustment of one or another of these parameters on energy of the accelerated beam is well known. The restorative signal 74 is of an appropriate magnitude in sense to return the beam energy to the preselected value represented by reference level 72 (and associated signal levels) which may necessarily be set to corresponding preset values for variable energy accelerator. The nature of signal 74 in application to the system depends upon which of the above mentioned parameters is selected for adjustment to achieve the desired energy stabilization.

Figure 5:
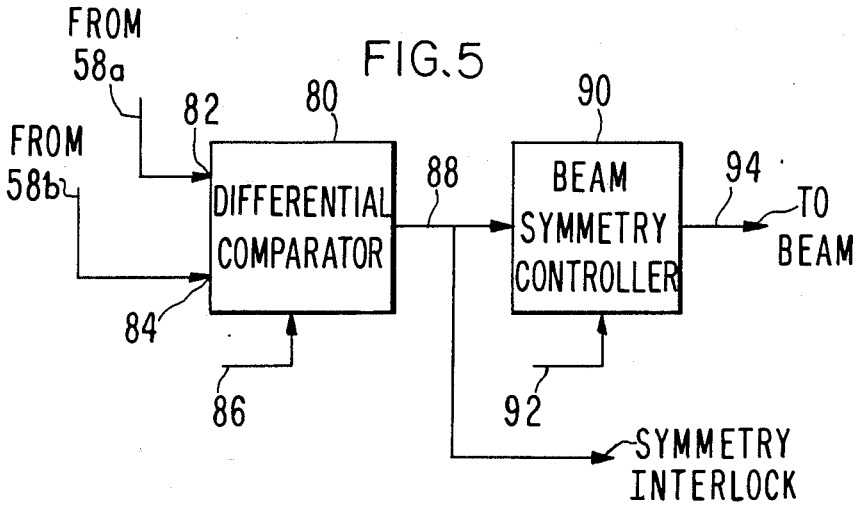
FIG. 5 shows a schematic representation of a steering stabilization portion of an accelerator employing the invention.

The segmented arrangement(s) of the type exemplified from FIGS. 3*b* and/or 3*c* offer sufficient information to stabilize or conform the beam geometrically with respect to the z-axis. The separate symmetric segment portions of ionization electrode pairs (or ring electrode segments), e.g., 58*a* and 58*c* are amplified and directed to a beam symmetry servo control as exemplified in FIG. 5. Separate signals obtained from, for example 58*a* and 58*b* are directed to respective inputs 82 and 84 in differential comparator 80. An externally supplied level 86 comprises a logical null which is externally derived as part of an adjustment for the beam. An output signal 88 represents the signed different of the signals present at inputs 82 and 84 and is directed either to a symmetry interlock, whereby the accelerator typically is turned off if beam asymmetry exceeds a preset lever, or to a beam symmetry controller 90 wherein the signal 88 is compared with reference 92 to provide a steering error signal appropriate to the transfer axis defined by the symmetrical pair of signal electrodes (for example 58*a* and 58*c*). Output 94 is provided to drive the appropriate steering subsystem so as to minimize the signal present at output 94.

The combination of beam symmetry monitoring together with the energy sensitivity of scattering, as above described, provides a system for which kinetic properties of the beam may be monitored independently of geometric characteristics over a reasonable range of energy and steering fluctuation.

A beam energy interlock system, after the above description, has been built and tested. A microwave accelerator furnishes an electron beam of 200 mA in bursts of about 4 μsec duration at 200 pps repetition rate and at a mean energy of about 2.3 MeV (±0.2 MeV). The beam passes, on axis, through the bore of a toroidal transformer and impinges on an 0.005" aluminum scattering foil. A ring collector is disposed on axis and downstream of the scattering foil to intercept an annular portion of the beam and to furnish a signal proportional to the intercepted beam. Articles for irradiation are disposed to intercept the beam at a distance of about 30 cm from the exit window of the accelerator. Beam energy excursions in excess of about 10% of the beam energy are easily detectable for application to interlock logic and to limit the energy excursion of the radiation applied to the workpiece.

It will be understood that, although the invention has been illustrated with reference to a particularly described embodiment, those skilled in the art will appreciate the changes in form and detail and be made within the scope of dependent claims.

What is claimed is:

1. An accelerator energy detector and stabilization system operative on an unanalyzed beam of charged particles comprising:

(a) accelerator means for producing a beam flux of charged particles of nominal energy $E_0$, said accelerator having at least one operating parameter for varying said nominal energy $E_0$, said beam flux defining a beam axis, (b) scattering means interposed on said beam axis for interacting with a fraction of said beam whereby said fraction of beam flux is deflected from a path substantially along said axis through a broad angular range with respect to said axis, (c) first scattered flux detector means disposed proximate said beam axis and displaced with respect to said axis subsequent to said scattering means for generating a first scattered flux signal indicative of the scattered fraction of the beam intercepted thereby, said disposition and displacement defining a nominal scattering angle $\theta_1$ whereby said scattered flux signal is representative of flux scattered through an angle $\theta_1$ with respect to said axis, (d) second scattered flux detector means disposed proximate said beam axis and displaced with respect to said axis subsequent to said scattering means for generating a second scattered flux signal indicative of the scattered fraction of the beam intercepted thereby, said disposition and displacement defining a nominal scattering angle $\theta_2$ whereby said scattered flux signal is representative of flux scattered through an angle $\theta_2$ with respect to said axis, (e) differential comparator means for processing said $\theta_1$ and $\theta_2$ signals and producing therefrom an energy difference signal proportional to a function of said $\theta_1$ and $\theta_2$ signals and said nominal energy $E_0$, (f) energy correction means for accepting said energy difference signal and for adjusting said operating parameter of said accelerator means.

2. The system of claim 1 wherein said first scattered flux detector means is disposed substantially on said axis whereby said nominal angle $\theta_1$ is 0°.

3. The system of claim 1 wherein at least one said scattered flux detector means comprises a plurality of coplanar azimuthal sampling means disposed in azimuthal symmetry about said axis, each said azimuthal sampling means for generating a corresponding azimuthal sampled signal and summing means for combining said corresponding azimuthal sampled signals to form the corresponding nominal $\theta_1$ or nominal $\theta_2$ signal.

4. The system of claim 1 further comprising beam symmetry monitoring means for detecting asymmetrical displacement of said beam axis from a predetermined axis.

5. The method of stabilizing an accelerator produced beam of charged particles comprising the steps of:

(a) accelerating charged particles to form a beam thereof of nominal energy $E_0$ in an accelerator, (b) passing said beam through a scattering material, (c) monitoring a first portion of said beam at a first locus following passage of said beam through said scattering material and generating a first signal, (d) detecting a second portion of said beam at a second locus following passage of said beam through said scattering material and generating a second signal, (e) forming a combination of first and second signals representative of the angular distribution of said beam and deriving therefrom the energy distribution of said beam and further relating said combination to the energy distribution of said beam, (f) relating said derived energy distribution to said nominal energy $E_0$ and forming an error signal representative of a difference between said nominal energy $E_0$ and the instantaneous energy of said beam, (g) applying said signal to affect said step of accelerating said beam.

6. The method of claim 5 wherein said step of applying comprises utilizing said error signal to actuate an accelerator system interlock to turn the beam off if the error exceeds a preset level.

7. The method of claim 5 wherein said step of applying comprises adjusting said accelerator to minimize said error signal and thereby hold the beam energy relatively constant.

* * * * *